US005450837A

United States Patent [19]

Uchikawa

[11] Patent Number: 5,450,837

[45] Date of Patent: Sep. 19, 1995

[54] APPARATUS AND METHOD FOR CONTROLLING THE AIR-FUEL RATIO OF AN INTERNAL COMBUSTION ENGINE

[75] Inventor: Akira Uchikawa, Atsugi, Japan

[73] Assignee: Unisia Jecs Corporation, Atsugi, Japan

[21] Appl. No.: 277,263

[22] Filed: Jul. 21, 1994

[30] Foreign Application Priority Data

Jul. 26, 1993 [JP] Japan ..... 5-184159

[51] Int. Cl.[6] ..... F01N 3/28; F02D 41/14

[52] U.S. Cl. ..... 123/692; 60/288

[58] Field of Search ..... 123/692, 691; 60/288, 60/276, 285

[56] References Cited

U.S. PATENT DOCUMENTS

| | | | |
|---|---|---|---|
| 4,107,921 | 8/1978 | Iizuka | 60/288 |
| 5,207,057 | 5/1993 | Kayanuma | 60/276 |
| 5,233,829 | 8/1993 | Komatsu | 60/276 |
| 5,247,793 | 9/1993 | Yamada et al. | 60/276 |
| 5,267,548 | 12/1993 | Roaenzopf et al. | 123/692 |
| 5,279,114 | 1/1994 | Kurita et al. | 60/276 |
| 5,341,788 | 8/1994 | Uchida | 123/692 |

FOREIGN PATENT DOCUMENTS

| | | | |
|---|---|---|---|
| 4-72438 | 3/1992 | Japan | 123/692 |

*Primary Examiner*—Raymond A. Nelli
*Attorney, Agent, or Firm*—Foley & Lardner

[57] ABSTRACT

With a V type engine, the exhaust air-fuel ratio is detected for each bank, and is also detected downstream of a catalytic converter which takes the combined exhaust flow from each bank. An air-fuel ratio feedback correction coefficient $\alpha$ is proportional-plus-integral controlled separately for each of the banks based on the air-fuel ratio detected for each of the banks, while a correction value PHOS for a proportional portion is set commonly for each of the banks, based on the air-fuel ratio detected downstream of the catalytic converter. Here the correction value PHOS is converted to separate correction values PHOSR, PHOSL for each of the banks corresponding to a change rate of the air-fuel ratio feedback correction coefficient $\alpha$ to an initial value, and the proportional operating amount of the proportional-plus-integral control which is carried out separately for each bank, is corrected based on the converted correction values PHOSR, PHOSL.

With such construction, the proportional operating amount can be suitably corrected corresponding the difference in the base air-fuel ratios occurring between the banks, so that the air-fuel ratio of each bank can be controlled to a high accuracy.

12 Claims, 5 Drawing Sheets

APPARATUS AND METHOD FOR CONTROLLING THE AIR-FUEL RATIO OF AN INTERNAL COMBUSTION ENGINE

FIELD OF THE INVENTION

The present invention relates to a method and apparatus for controlling the air-fuel ratio of an internal combustion engine, and in particular to such apparatus and method which detect the oxygen concentration in the exhaust gas upstream and downstream respectively of an exhaust gas purification catalytic converter, and carry out air-fuel ratio feedback control based on the detected results. More particularly the invention relates to air-fuel ratio feedback control technology for internal combustion engines wherein air-fuel ratio feedback control is carried out independently for each of two cylinder groups.

DESCRIPTION OF THE RELATED ART

Heretofore, there have been various proposals for air-fuel ratio feedback control wherein the air-fuel ratio is feedback controlled based on detection values from two oxygen sensors respectively disposed upstream and downstream of a three-way exhaust gas purification catalytic converter arranged in an exhaust system (Japanese Unexamined Patent Publication No. 4-72438).

With the air-fuel ratio feedback control apparatus disclosed in Japanese Unexamined Patent Publication No. 4-72438 for example, compensation for deviation of an air-fuel ratio control point in an air-fuel ratio feedback control based on the detected results of the upstream oxygen sensor, involves setting an air-fuel ratio feedback correction coefficient by a proportional-plus-integral control based on detected results of the upstream oxygen sensor, and correcting a proportional operating amount (proportional portion) in a proportional-plus-integral control based on richness or leanness with respect to the target air-fuel ratio, detected by the downstream oxygen sensor.

With "V" type or horizontally opposed type engines however having two banks of cylinders, oxygen sensors are provided respectively in the separate exhaust manifolds provided for each of the banks (for each cylinder group), and air-fuel ratio feedback control is carried out independently for each bank using the values detected by each oxygen sensor to set separate air-fuel ratio feedback correction values for each bank.

With such a system wherein air-fuel ratio feedback control is carried out for each of the banks, an improvement in the accuracy of the air-fuel ratio control can be expected, if the exhaust air-fuel ratio is detected using an oxygen sensor provided downstream of a catalytic converter which takes the combined exhaust gases from each bank, and a correction based on the detected result is made commonly to the air-fuel ratio feedback controls for each of the banks.

It is common however for the base air-fuel ratio conditions for each of the banks to differ, and in this case, the correction requirements for each of the banks will also differ. Therefore, the abovementioned common correction for each bank based on the detected results of the oxygen sensor downstream of the catalytic converter, will not give an optimum value for correction of each bank. Consequently, with a system wherein the air-fuel ratio is feedback controlled for each of the banks, it is difficult to stably obtain a high control accuracy, even though correction may be carried out evenly based on the oxygen sensor downstream of the catalytic converter which detects the total exhaust air-fuel ratio of the banks.

SUMMARY OF THE INVENTION

In view of the above problems with air-fuel ratio control apparatus wherein individual air-fuel ratio feedback control is carried out for each of two cylinder groups, it is an object of the present invention to carry out optimum air-fuel ratio control in correspondence with air-fuel ratio deviation characteristics of each cylinder group, based on detected results of exhaust air-fuel ratio downstream of a catalytic converter which takes the combined exhaust gases from each bank.

Moreover, it is an object of the present invention to be able to accurately control the air-fuel ratio for each cylinder group to the target air-fuel ratio, by accurately detecting the deviation characteristics of the air-fuel ratio for each cylinder group.

To achieve the above objects, the apparatus and method for controlling the air-fuel ratio of an internal combustion engine according to the present invention, comprises first and second oxygen sensors provided in respective exhaust paths independently provided for each of two cylinder groups, for detecting the oxygen concentration in the exhaust gases of each cylinder group, and a third oxygen sensor in an exhaust path downstream of an exhaust gas purification catalytic converter, which takes the combined exhaust gases from the two cylinder groups, for detecting the oxygen concentration in the combined exhaust gases. An air-fuel ratio control value is set separately for each cylinder group based on the oxygen concentrations for each cylinder group, respectively detected by the first and second oxygen sensors, while a common air-fuel ratio control value is set for each cylinder group based on the oxygen concentration detected by the third oxygen sensor. The common air-fuel ratio control value for each cylinder group is then converted into a separate air-fuel ratio control value for each cylinder group based on said air-fuel ratio control value set separately for each cylinder group based on the oxygen concentrations respectively detected by the first and second oxygen sensors, and the air-fuel ratio is controlled independently for each cylinder group based on the air-fuel ratio control value set separately for each cylinder group, and the separate air-fuel ratio control value for each cylinder group obtained by conversion of the common air-fuel ratio control value.

With such a construction, the air-fuel ratio control value set on the basis of the detected results of the third oxygen sensor, is not used commonly for each of the cylinder groups as is, but is converted to an air-fuel ratio control value corresponding to a difference in the air-fuel ratio characteristics of each cylinder group based on the air-fuel ratio control value of the separate cylinder groups which is set based on the detection results of the first and second oxygen sensors, and air-fuel ratio control is carried out independently for separate cylinder groups using the converted air-fuel ratio control value.

Moreover, with the present invention the construction may be such that converting the common air-fuel ratio control value for each cylinder group into a separate value for each cylinder group involves converting the air-fuel ratio control value set as a common value for each cylinder group into a separate air-fuel ratio control value for each cylinder group based on a comparison of the air-fuel ratio control value set separately for each cylinder group with the initial value of the air-fuel ratio control value for each cylinder group.

With such a construction, the conditions of the base air-fuel ratio for each cylinder group can be known by comparing the air-fuel ratio control value set separately for each cylinder group with the initial value of the air-fuel ratio control value, so that the air-fuel ratio control value set commonly for each cylinder group can be convened to a value which accurately corresponds to the air-fuel ratio characteristic of each cylinder group.

Moreover, with the present invention the construction may be such that converting the common air-fuel ratio control value for each cylinder group into a separate value for each cylinder group involves multiplying the air-fuel ratio control value set as a common value for each cylinder group, by the ratio of the air-fuel ratio control value set separately for each cylinder group to the initial value.

With such a construction, the conversion of the air-fuel ratio control value corresponding to the air-fuel ratio characteristics for each of the cylinder groups can be easily carried out.

Moreover, with the present invention the construction may be such that converting the common air-fuel ratio control value for each cylinder group into a separate value for each cylinder group involves detecting the respective air-fuel ratio deviation characteristics for each cylinder group based on the comparison of the air-fuel ratio control value set separately for each cylinder group with the initial value, and correctingly setting the common air-fuel ratio control value for each cylinder group in a direction to suppress the respective base air-fuel ratio deviations of each cylinder group.

With such a construction, the air-fuel ratio control can be carried out based on the detected results of the third oxygen sensor with characteristics corresponding to the deviations of the base air-fuel ratios for each of the cylinder groups, so that the target air-fuel ratio can be obtained to a high accuracy for each of the cylinders.

Moreover, with the present invention the construction may be such that when setting the air-fuel ratio control value separately set for each cylinder group and the common air-fuel ratio control value for each cylinder group based on the outputs of the oxygen sensors involves judging the richness or leanness of the actual air-fuel ratio compared to the target air-fuel ratio based on the outputs of the oxygen sensors, and changing the air-fuel ratio control value in a direction so that the actual air-fuel ratio approaches the target air-fuel ratio.

With such a construction, the air-fuel ratio feedback control is carried out to give a target air-fuel ratio for each respective cylinder group, or on the other hand, the air-fuel ratio feedback control is carried out so that the average air-fuel ratio of all cylinders becomes the target air-fuel ratio. It is therefore possible to have air-fuel ratio control which is compensated for deviation of the control point due to the first and second oxygen sensors.

Moreover, with the present invention the construction may be such that controlling the air-fuel ratio separately for each cylinder group involves, correcting separately for each cylinder group, an operating amount for the air-fuel ratio control value at the time of setting the air-fuel ratio control value separately for each cylinder group, based on the separate air-fuel ratio control value for each cylinder group obtained by conversion of the common air-fuel ratio control value for each cylinder group.

With such a construction, when the air-fuel ratio control value is controlled based on the first and second oxygen sensors, then the control characteristics of this air-fuel ratio control value are corrected based on the air-fuel ratio detected by the third oxygen sensor, and the deviation of the air-fuel ratio control using the first and second oxygen sensors is adjusted.

Other objects and aspects of the present invention will become apparent from the following description of an embodiment given in conjunction with the appended drawings.

DETAILED DESCRIPTION OF A PREFERRED EMBODIMENT

Figure 1:
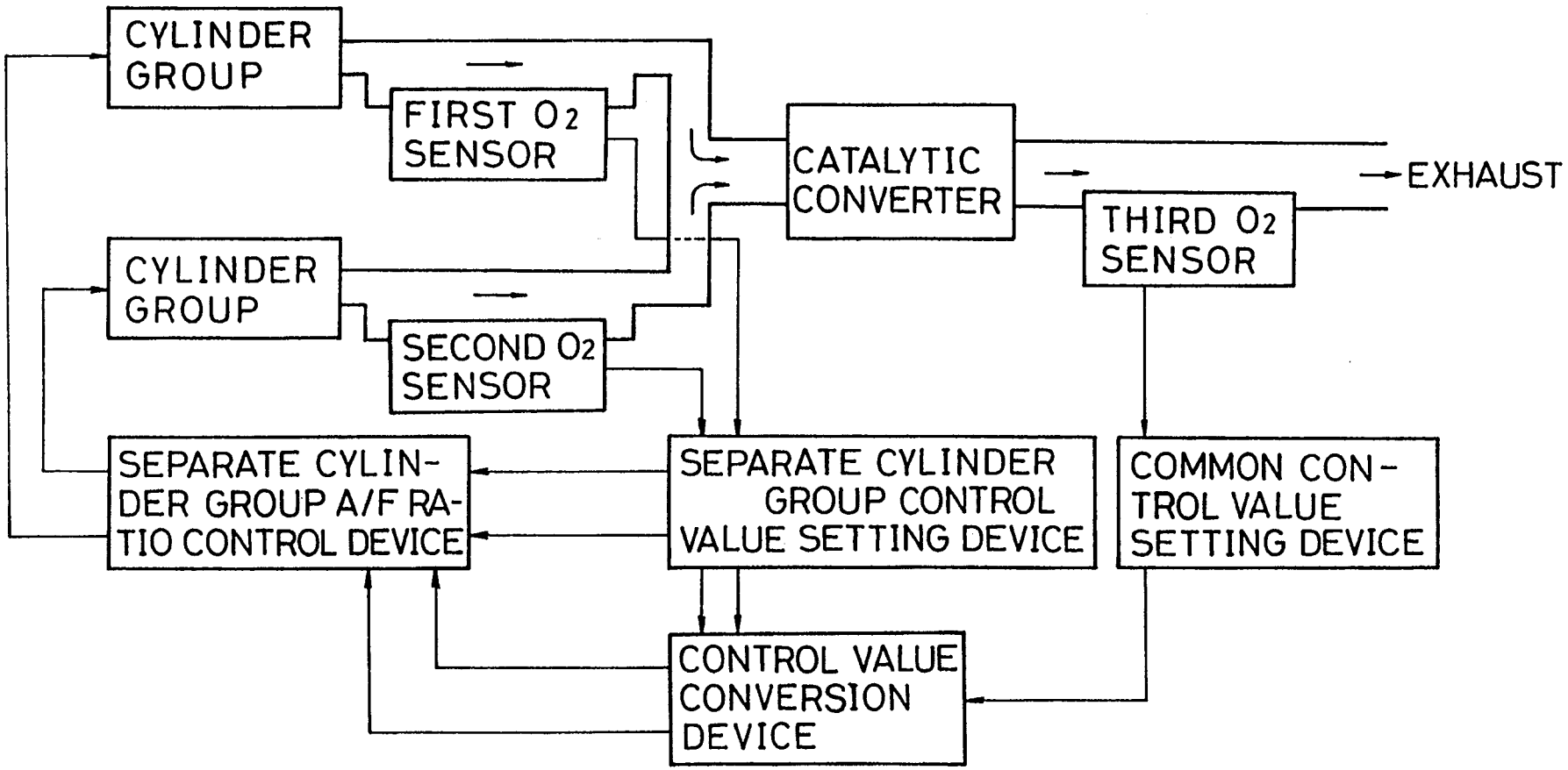
FIG. 1 is a block diagram showing the basic arrangement of an air-fuel ratio control apparatus according to the present invention.

A basic arrangement of an air-fuel ratio control apparatus for an internal combustion engine according to the present invention is shown in FIG. 1, while an embodiment of the apparatus and method for controlling the air-fuel ratio of an internal combustion engine according to the present invention is shown in FIG. 2 through FIG. 5.

Figure 2:
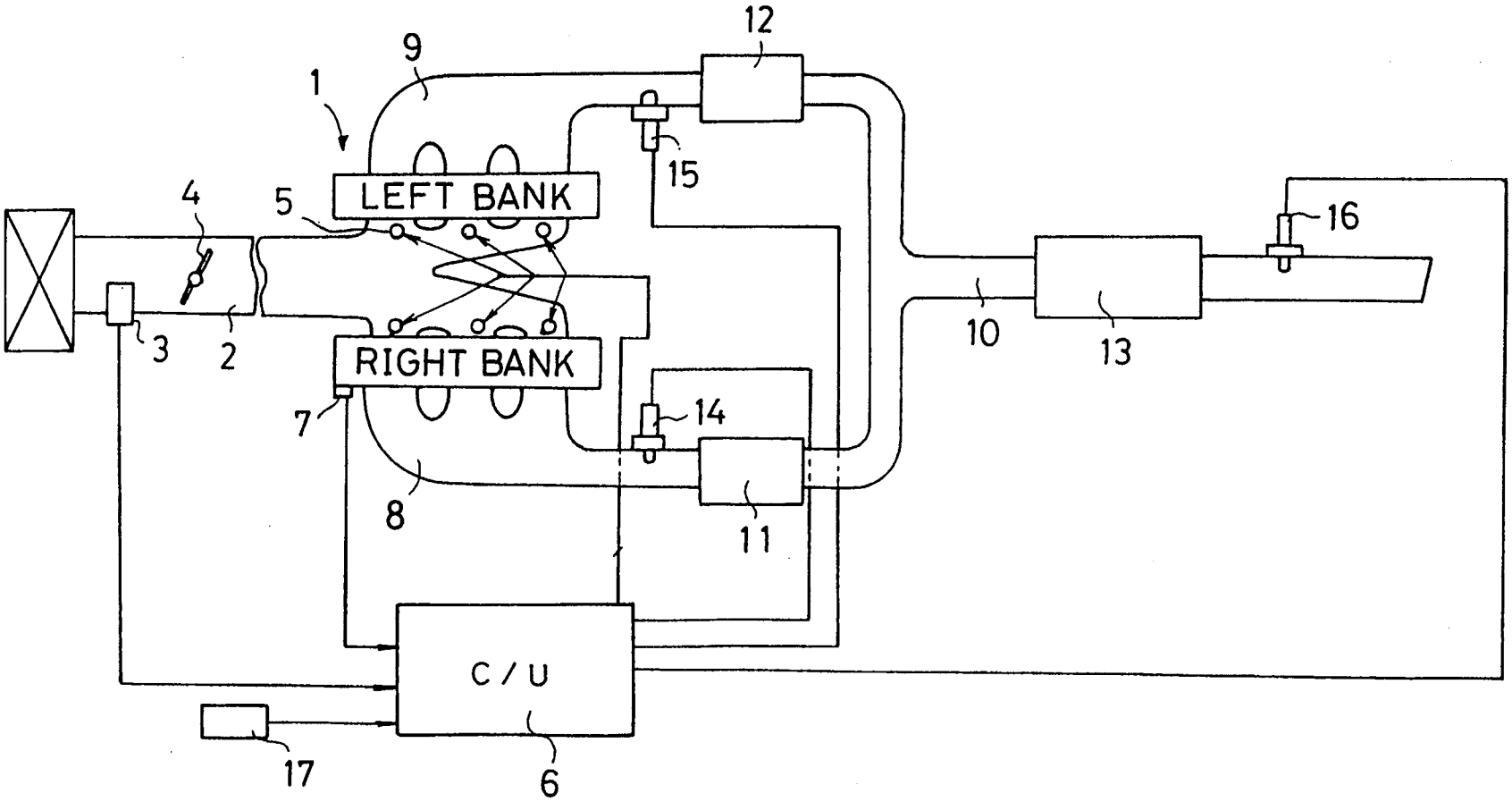
FIG. 2 is a schematic system diagram showing a system structure of an embodiment of the present invention.

Referring to the system structure of the embodiment shown in FIG. 2, a "V" type internal combustion engine 1 has an intake path 2 which is provided with an air flow meter 3 for detecting an intake air quantity Q of the engine 1, and a throttle value 4 linked to an accelerator pedal (not shown), for controlling the engine intake air quantity Q. Electromagnetic type fuel injection valves 5 are provided for each of the cylinders at respective branch portions of a downstream intake manifold.

The fuel injection valves 5 are driven open in response to an injection pulse signal provided by a control unit 6 incorporating a microcomputer, so that fuel pressurized by a fuel pump (not shown), and controlled to a predetermined pressure by means of a pressure regulator, is injected to inside the intake manifold.

Moreover, a water temperature sensor 7 is provided for detecting the cooling water temperature Tw in the cooling jacket of the engine 1.

The two banks of cylinder groups of the engine 1 form a V shape with a right bank (first cylinder group) and a left bank (second cylinder group). Respective exhaust manifolds 8, 9 are provided for each bank (cylinder groups) to separately take the exhaust from each bank. The exhaust manifolds 8, 9 are combined together downstream to form a single exhaust path 10, whereby the exhaust gas for each bank taken separately by the exhaust manifolds 8, 9 is combined together and discharged.

Pre-catalytic converters 11, 12 for exhaust gas purification are respectively disposed in each exhaust manifold 8, 9 (exhaust paths) upstream of the combined portion, while a main catalytic converter 13 is disposed in the exhaust path 10.

Moreover, oxygen sensors 14, 15 (first and second oxygen sensors) which detect the air-fuel ratio of the engine intake mixture by detecting the oxygen concentration in the exhaust gas, are respectively disposed in each exhaust manifold 8, 9 upstream of the pre-catalytic converters 11, 12, so as to detect the oxygen concentration in the exhaust gas of each of the banks. Also provided is an oxygen sensor 16 (third oxygen sensor) downstream of the main catalytic converter 13, for detecting the oxygen concentration in the combined exhaust gases from each bank.

The oxygen sensors 14 through 16 are known sensors whose output values change in response to the concentration of oxygen in the exhaust gas. They are rich/lean sensors which utilize the fact that the concentration of oxygen in the exhaust gas drastically changes around the theoretical air-fuel ratio, to detect if the exhaust air-fuel ratio is richer or leaner than the theoretical air-fuel ratio.

Moreover, a crank angle sensor 17 is incorporated in a distributor (not shown). The crank angle sensor 17 outputs a unit crank angle signal for each unit crank angle, and a reference crank angle signal for each predetermined piston position. The number of unit crank angle signals for a fixed period is counted, or the period of the reference crank angle signal is measured, to thereby detect the engine rotational speed Ne.

The control unit 6 computes a basic fuel injection quantity Tp based on the intake air quantity Q and the engine rotational speed Ne, and respectively computes by proportional-plus-integral control, separate air-fuel ratio feedback correction coefficients $\alpha R$, $\alpha L$ (air-fuel ratio control values) for each cylinder group such that the air-fuel ratio for each of the banks detected by the oxygen sensors 14, 15 approaches the target air-fuel ratio (theoretical air-fuel ratio).

Correction requirements for different operating regions are then learned separately for each cylinder group based on the air-fuel ratio feedback correction coefficients $\alpha R$, $\alpha L$ computed for the separate cylinder groups. Separate air-fuel ratio learning correction values KBLRR, KBLRL (air-fuel ratio control values) for each cylinder group which are stored for each of the operating regions (partitioned on the basis of basic fuel injection quantity Tp and engine rotational speed Ne), are then respectively rewritten based on the learned results.

Then the basic fuel injection quantity Tp is corrected by the air-fuel ratio feedback correction coefficients $\alpha R$, $\alpha L$ and the air-fuel ratio leaning correction values KBLRR, KBLRL to thereby compute optimum fuel injection quantities TiR ($TiR = Tp \times \alpha R \times KBLRR$), TiL ($TiL = Tp \times \alpha L \times KBLRL$) separately for each cylinder group. An injection pulse signal according to the fuel injection quantities TiR, TiL for each separate cylinder group is then sent to the corresponding fuel injection valves 5 to thereby control the fuel injection quantity while carrying out air-fuel ratio control separately for each cylinder group.

Furthermore, deviation of the control point in the air-fuel ratio feedback control using the upstream oxygen sensors 14, 15 is detected by the oxygen sensor 16 downstream of the main catalytic converter 13, and the proportional operating amount in the air-fuel ratio feedback control is corrected based on the detected result.

The air-fuel ratio feedback control routines for each bank are described in detail as follows with reference to the flow charts of FIG. 3 through FIG. 5.

Figure 3:
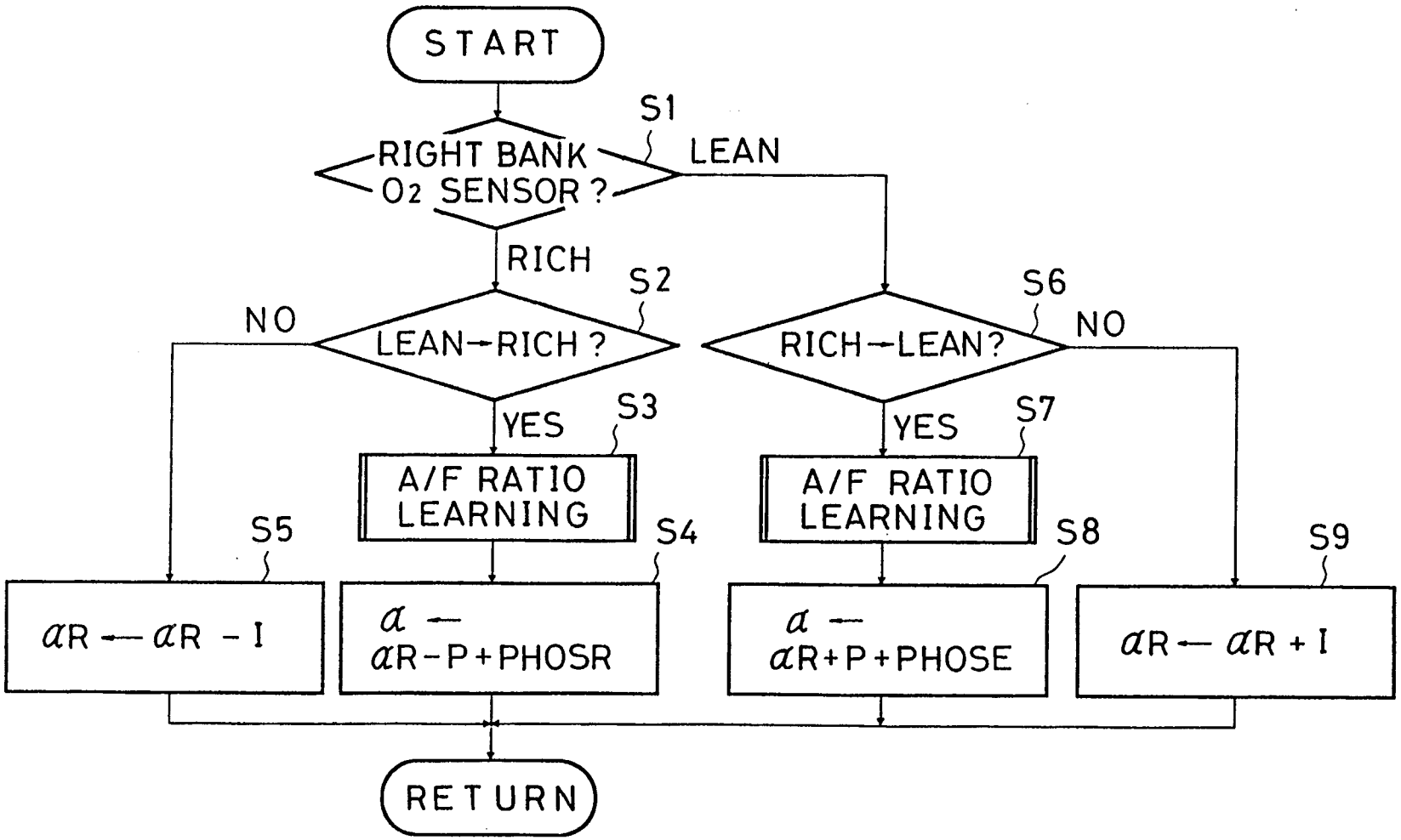
FIG. 3 is a flow chart showing an air-fuel ratio control routine which uses an upstream oxygen sensor, according to the embodiment.
Figure 4:
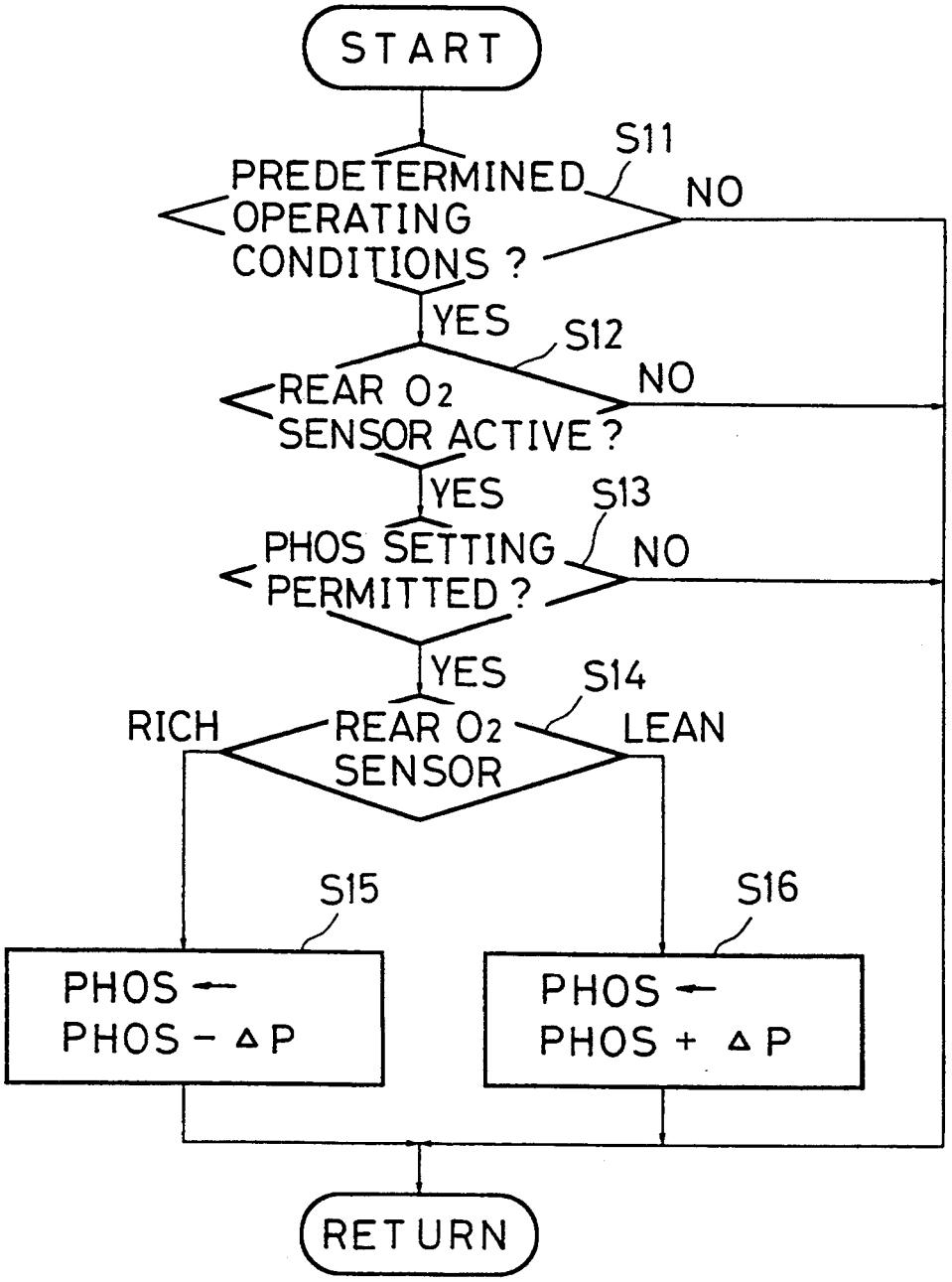
FIG. 4 is a flow chart showing an air-fuel ratio control routine which uses a downstream oxygen sensor, according to the embodiment.
Figure 5:
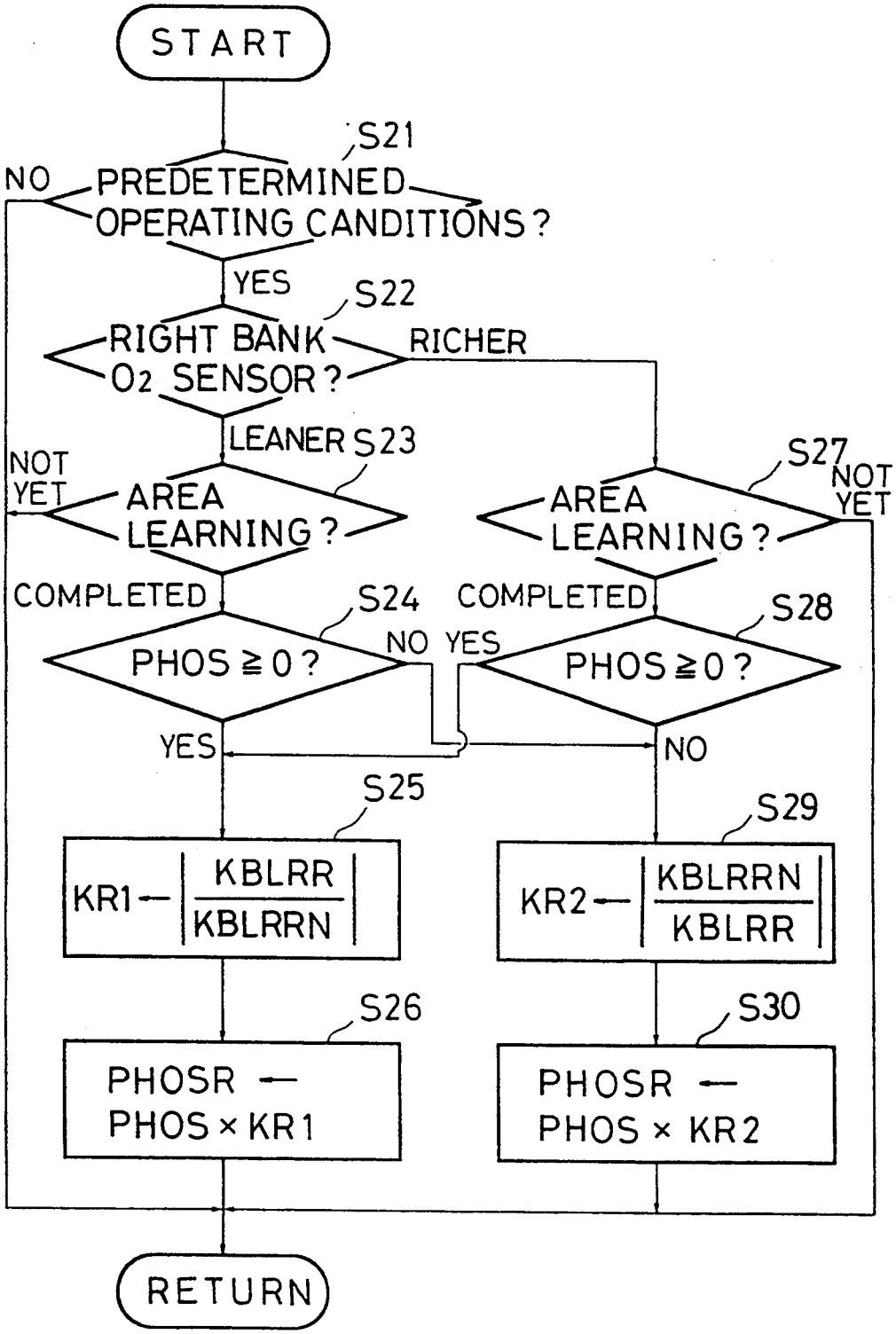
FIG. 5 is a flow chart showing a treatment routine for adapting correction controls for each of the banks according to the embodiment.

In the present embodiment, the functions of a separate cylinder group control value setting device, a common control value setting device, a control value conversion device, and a separate cylinder group air-fuel ratio control device as shown in FIG. 1, are realized by software illustrated by the flow charts of FIG. 3 through FIG. 5 and stored in the control unit 6.

The flow chart of FIG. 3 shows the computational processing for proportional-plus-integral control of the right bank air-fuel ratio feedback correction coefficient $\alpha R$, and for separately learning the air-fuel ratio feedback correction coefficient $\alpha R$ for each of the operating regions to thereby update the air-fuel ratio leaning correction value KBLRR.

The left bank air-fuel ratio feedback correction coefficient $\alpha L$ and air-fuel ratio leaning correction value KBLRL are separately controlled using a left bank correction value PHOSL in exactly the same way as the computational processing shown in the flow chart of FIG. 3. Description of this processing is thus omitted for the present embodiment.

In the flow chart of FIG. 3, initially in step 1 (with "step" denoted by S in the figures), richness or leanness of the air-fuel ratio with respect to a target air-fuel ratio (theoretical air-fuel ratio) is judged based on the outputs of the oxygen sensor 14 provided for the right bank.

When judged that the air-fuel ratio is richer than the target air-fuel ratio, control proceeds to step 2 where it is judged if this is a first inversion from lean to rich.

If a first inversion, control proceeds to step 3 where a correction requirement for the current operating conditions is detected from an average value of the air-fuel ratio feedback correction coefficient $\alpha R$ (initially equal to 1.0). Air-fuel ratio learning is then carried out to update the right bank air-fuel ratio leaning correction value KBLRR (initially equal to 1.0) stored in an air-fuel ratio learning map for each of the operating regions to meet the correction requirement.

Then in step 4, a computation is made involving subtracting a predetermined proportional portion P (proportional operating amount) from the previous air-fuel ratio feedback correction coefficient $\alpha R$, and adding a right bank proportional portion correction value PHOSR (air-fuel ratio control value). The computed result is then set as a new air-fuel ratio feedback correction coefficient $\alpha R$ ($\alpha R = \alpha R - P + PHOSR$).

When judged in step 2 not to be the first inversion to rich, control proceeds to step 5 where computation is made involving subtracting a predetermined integral portion I (integral operating amount) from the previous air-fuel ratio feedback correction coefficient $\alpha R$. The computed result is then set as a new air-fuel ratio feedback correction coefficient $\alpha R$ ($\alpha R = \alpha R - 1$).

When judged in step 1 that the right bank air-fuel ratio is leaner, proportional-plus-integral control and air-fuel ratio learning for the air-fuel ratio feedback correction coefficient $\alpha R$ are carried out in a similar manner. However the proportional control for the first inversion to lean involves a computation updating the air-fuel ratio feedback correction coefficient $\alpha R$ to $\alpha R + P + PHOSR$. Moreover integral control involves updating the air-fuel ratio feedback correction coefficient $\alpha R$ to $\alpha R+1$ (step 6 to step 9).

The proportional portion correction value PHOSR thus has the effect of correcting the proportional control operating amount at the time of rich to lean or lean to rich inversion. When the proportional portion correction value PHOSR has a positive value, then the proportional operating amount in the rich direction (the direction of increase of the correction coefficient $\alpha R$) increases in proportion to the increase of the value PHOSR, while the operating amount in the lean direction decreases. Moreover, when the proportional portion correction value PHOSR has a negative value, the proportional operating amount in the lean direction increases in proportion to the reduction of the value PHOSR, while the operating amount in the rich direction decreases.

Correcting the proportional operating amount in the abovementioned manner adjusts the control point for the air-fuel ratio feedback correction coefficient $\alpha R$ in the right bank. For example, if the proportional operating amount for increasing control of the correction coefficient $\alpha R$ at the time of rich to lean inversion is increased, then the control point for the correction coefficient $\alpha R$ is adjusted towards the rich side.

The proportional portion correction value PHOSR is variably set in accordance with a program illustrated by the flow charts of FIG. 4 and FIG. 5.

The flow chart of FIG. 4 is a program for computing the proportional portion correction value PHOS (initially equal to zero) as an air-fuel ratio control value common to each bank, based on the air-fuel ratio detected by the oxygen sensor 16 downstream of the main catalytic converter 13.

In the flow chart of FIG. 4, initially in step 11, it is judged if the setting conditions for the correction value PHOS have materialized, based on the operating conditions such as engine load and engine rotational speed.

When operating conditions have materialized, control proceeds to step 12 where an active state of the oxygen sensor 16 is confirmed, for example by the output voltage range thereof. If confirmed active, control proceeds on to step 13.

In step 13, it is judged if the conditions prohibit correction by the oxygen sensor 16. For example, immediately after a lean control, such as fuel shut-off and the like. When the conditions permit correction using the oxygen sensor 16, control proceeds to step 14.

In step 14, it is judged if the total exhaust air-fuel ratio of the banks is richer or leaner than the target air-fuel ratio (theoretical air-fuel ratio) based on the output from the oxygen sensor 16.

When the air-fuel ratio is richer than the target air-fuel ratio, control proceeds to step 15 where the proportional portion correction value PHOS is adjusted to decrease by a predetermined value $\Delta P$, while when the air-fuel ratio is leaner than the target air-fuel ratio, control proceeds to step 16 where the proportional portion correction value PHOS is adjusted to increase by a predetermined value $\Delta P$.

Since the increase adjustment of the proportional portion correction value PHOS shifts the control point of the air-fuel ratio feedback control to a rich direction, then this adjustment control of the proportional portion correction value PHOS results in the air-fuel ratio detected by the oxygen sensor 16 approaching the target air-fuel ratio.

The correction value PHOS computed according to the program shown in FIG. 4 is set so that the total air-fuel ratio of the left and right banks coincides with the target air-fuel ratio. It is a value which indicates the average correction requirements for the left and right banks, but is not necessarily an optimum value for each bank.

The flow chart of FIG. 5 carries out a control to convert the correction value PHOS into a correction value PHOSR which is suitable for the right bank, and corresponds to the air-fuel ratio correction requirements (base air-fuel ratio) for the right bank.

Since computation for the left bank correction value PHOSL is the same as for the right bank correction value PHOSR as shown in the flow chart of FIG. 5, description is omitted for the present embodiment.

In the flow chart of FIG. 5, in step 21, a judgment is made of the operating conditions. When conditions for setting the correction value PHOSR have materialized, control proceeds to step 22.

In step 22, the richness or leanness of the right bank air-fuel ratio is judged based on the output of the oxygen sensor 14 provided for the right bank.

When the air-fuel ratio of the right bank is for example leaner than the target air-fuel ratio, control proceeds to step 23, where it is judged if the air-fuel ratio learning in the operating region corresponding to the current operating conditions is converging. If the air-fuel ratio learning in the corresponding region is converging, the learned air-fuel ratio correction value KBLRR for the corresponding region indicates the correction requirements, and the base air-fuel ratio, for the operating region.

When the air-fuel ratio learning has converged, control proceeds on to step 24, where it is judged if the correction value PHOS set according to the flow chart of FIG. 4 is equal to or greater than zero.

If the correction value PHOS is equal to or greater than zero, control proceeds to step 25 where the value of the air-fuel ratio leaning correction value KBLRR (which has been learned and stored in the air-fuel ratio learning map for the right bank) for the operating region which includes the current operating conditions is read. The absolute value of the ratio of the learning correction value KBLRR and the initial learning value KBLRRN for the relevant operating region is then computed, and the results set as a correction coefficient KR1 ($KR1=|KBLRR / KBLRRN|$) for the correction value PHOS.

The initial learning value KBLRRN is one which is initially learned for new conditions of the engine 1 (or oxygen sensor 14), or is an initial value which has essentially had no correction (for example=1.0).

Then in the next step 26, the proportional portion correction value PHOS which is increasingly or decreasingly set as mentioned above so that the air-fuel ratio detected by the downstream oxygen sensor 16 approaches the target air-fuel is multiplied by the correction coefficient KR1. The computed result is then set as the proportional portion correction value PHOSR for the right bank.

For example, when the air-fuel ratio leaning correction value KBLRR for the right bank is incremented to correspond with a lean direction change in the base air-fuel ratio for the right bank, the correction coefficient KR1 becomes greater than 1, and the result of the increase correction of the proportional portion correction value PHOS is set as the correction value PHOSR for the right bank.

Here when control proceeds consecutively from step 22 to step 25, then since the detection results for the oxygen sensor 14 are lean, the correction value PHOSR is used in the computation of step 8 in the flow chart of FIG. 3. That is to say it is used in the increase control with the proportional portion of the air-fuel ratio feedback correction coefficient $\alpha R$ for first time rich to lean inversion of the air-fuel ratio.

Moreover, since in step 24 it is judged if the correction value PHOS is equal to or greater than zero, then when the right bank has a lean tendency, the proportional portion which increasingly corrects the correction coefficient $\alpha R$ at the time of rich to lean inversion, is made greater by means of the process of step 26, so that the computational characteristics of the correction coefficient $\alpha R$ (air-fuel ratio feedback control characteristics for the right bank) are adjusted towards the rich side.

On the other hand, when in step 24 the correction value PHOS is judged to have a negative value, then when the correction value PHOS is incremented, the computational characteristics of the correction coefficient $\alpha R$ are adjusted towards the lean side, since the lean trend in the right bank can not be compensated. In this case, control proceeds to step 29, where the correction coefficient KR2 is obtained by the computation |KBLRRN / KBLRR|. Then in the step 30, the correction value PHOS multiplied by the correction coefficient KR2 is set as the right bank correction value PHOSR.

As a result, the base air-fuel ratio of the right bank has a rich trend. Moreover, when the air-fuel ratio detected by the oxygen sensor 14 is lean, and the correction coefficient $\alpha R$ is increase controlled by the proportional control, the correction value PHOS is increasingly corrected if the correction value PHOS is positive, and decreasingly corrected if the correction value PHOS is negative, to hereby set the right bank proportional portion correction value PHOSR. In either case, the increase correction portion with the proportional control of the correction coefficient $\alpha R$ becomes greater than when the correction value PHOS is used as is. The control point can thus be adjusted towards the rich side to deal with the lean trend of the right bank.

In a similar manner, when a rich trend in the right bank is judged by means of the lair-fuel ratio leaning correction value KBLRR, that is to say, when the relationship becomes KBLRR<KBLRRN, then the increase control proportion by the proportional control of the correction coefficient $\alpha R$ becomes smaller than when using the correction value PHOS as is. The control point can thus be adjusted towards the lean side to deal with the rich trend in the right bank.

Moreover, when judged in step 22 that the oxygen sensor 14 is detecting a rich condition of the right bank, then since the proportional portion correction value PHOSR is being used in the reducing proportional control of the correction coefficient $\alpha R$ at the time of lean to rich inversion, then when the base air-fuel ratio of the right bank has a rich trend (KBLRR<KBLRRN), the reduction control proportion for the proportional control can be increased. Conversely, in the case of a lean trend (KBLRRN<KBLRR), the reduction control proportion for the proportional control can be decreased.

Accordingly, control proceeds from step 22 to step 27 to step 28. When in step 28 the PHOS is judged to have a positive value, control proceeds on to step 25, where the correction coefficient KR1 is computed to be a value less than the "1" if the right bank has a rich trend, or a value greater than "1" if the right bank has a lean trend.

Conversely, control proceeds from step 22 to step 27 to step 28. When in step 28 the PHOS is judged to have a negative value, control proceeds on to step 29, where the correction coefficient KR2 is computed to be a value greater than 1 if the right bank has a rich trend or a value less than 1 if the right bank has a lean trend.

In this way, when for example the base air-fuel ratio of the right bank has a rich trend, then the reduction control portion by the proportional control of the correction coefficient $\alpha R$ when the correction value PHOS is used as is. On the other hand, in the case of a lean trend, the proportion for reduction control of the correction coefficient $\alpha R$ by proportional control, becomes smaller. Accordingly, in either case, the correction value PHOS is adjusted so that the base air-fuel ratio of the right bank approaches the target air-fuel ratio, and the right bank correction value PHOSR is set. As a result, the control point of the air-fuel ratio feedback control for the right bank is adjusted in a direction which compensates for the change in the base air-fuel ratio.

In this way, the change in base air-fuel ratio occurring in the right bank can be known based on the air-fuel ratio learning correction value KBLRR for the right bank, and the correction value PHOS thus corrected in a direction to compensate for the change in the base air-fuel ratio. When the right bank has a rich trend, the control point of the right bank air-fuel ratio feedback control carried out with the correction coefficient $\alpha R$ is corrected, so as to be greater in the lean direction. On the other hand, when the right bank has a lean trend, the right bank air-fuel ratio feedback control point is corrected by the correction coefficient $\alpha R$ so as to be greater in the rich direction.

The flow charts of FIG. 3 and FIG. 5 are both set for the right bank. However programs which carry out the same computational processing are also set for the left bank. With the left bank also, the correction value PHOS is not used as is, but instead, the deviation of the base air-fuel ratio for the left bank is detected by means of the left bank air-fuel ratio learning correction value KBLRL, and the correction value PHOS is corrected based on the detected results, to thus establish a correction value PHOSL for use in the proportional control of the left bank air-fuel ratio feedback correction coefficient $\alpha L$.

Therefore with the present invention, the correction value PHOS obtained based on the total exhaust from each bank, is adjusted to a suitable value for each bank corresponding to the deviation trend of the base air-fuel ratio in each bank. Then the air-fuel ratio feedback control for each of the banks is corrected based on the adjusted correction values PHOSR, PHOSL, is corrected. Consequently, correction control which utilizes the detection results of the oxygen sensor 16 provided downstream of the catalytic converter, is optimally carried out for each of the banks, so that the accuracy of air-fuel ratio feedback control for each of the banks can be stably improved.

While the construction of the present embodiment as mentioned above incorporates the pre-catalytic converters 11, 12, it is also possible to have a construction with only the main catalytic converter 13 as the catalytic converter.

Moreover the method of correcting the air-fuel ratio feedback control which uses the oxygen sensors 14, 15 upstream of the catalytic converter, on the basis of the detection results of the oxygen sensor provided downstream of the catalytic converter, is not limited to the abovementioned correction control of the proportional portion. For example it is also possible to have a construction wherein the judgment level in the rich/lean judgement is adjusted based on the output of the oxygen sensors 14, 15, or a construction wherein a delay time from detection of the rich to lean or lean to rich inversion until execution of the actual proportional control is adjusted.

I claim:

1. An apparatus for controlling the air-fuel ratio of an internal combustion engine comprising;

first and second oxygen sensors provided in respective exhaust paths independently provided for each of two cylinder groups, for detecting the oxygen concentration in the exhaust gases of each cylinder group, a third oxygen sensor in an exhaust path downstream of an exhaust gas purification catalytic converter, which takes the combined exhaust gases from the two cylinder groups, for detecting the oxygen concentration in the combined exhaust gases, separate cylinder group control value setting means for setting an air-fuel ratio control value separately for each cylinder group based on the oxygen concentrations for each cylinder group, respectively detected by said first and second oxygen sensors, common control value setting means for setting a common air-fuel ratio control value for each cylinder group based on the oxygen concentration detected by said third oxygen sensor, control value conversion means for converting the common air-fuel ratio control value for each cylinder group set by said common control value setting means, into a separate air-fuel ratio control value for each cylinder group based on said air-fuel ratio control value separately for each cylinder group set by said separate cylinder group control value setting means, and separate cylinder group air-fuel ratio control means for controlling the air-fuel ratio independently for each cylinder group based on the air-fuel ratio control value separately for each cylinder group set by said separate cylinder group control value setting means, and the separate air-fuel ratio control value for each cylinder group convened by said control value conversion means.

2. An apparatus for controlling the air-fuel ratio of an internal combustion engine according to claim 1, wherein said control value conversion means converts the air-fuel ratio control value set as a common value for each cylinder group into a separate air-fuel ratio control value for each cylinder group based on a comparison of the air-fuel ratio control value set separately for each cylinder group with the initial value.

3. An apparatus for controlling the air-fuel ratio of an internal combustion engine according to claim 2, wherein said control value conversion means multiplies the air-fuel ratio control value set as a common value for each cylinder group, by the ratio of the air-fuel ratio control value set separately for each cylinder group to the initial value, to convert the common value into a separate air-fuel ratio control value for each cylinder group.

4. An apparatus for controlling the air-fuel ratio of an internal combustion engine according to claim 2, wherein said control value conversion means detects the respective air-fuel ratio deviation characteristics for each cylinder group based on a comparison of the air-fuel ratio control value separately set for each cylinder group with the initial value, and correctingly sets the common air-fuel ratio control value for each cylinder group in a direction to suppress the respective base air-fuel ratio deviations of each cylinder group, thus converting the common air-fuel ratio control value into a separate air-fuel ratio control value for each cylinder group.

5. An apparatus for controlling the air-fuel ratio of an internal combustion engine according to claim 1, wherein said separate cylinder group control value setting means and said common control value setting means, judge the richness or leanness of the actual air-fuel ratio compared to the target air-fuel ratio based on the outputs of the respective oxygen sensors, and change the air-fuel ratio control value in a direction so that the actual air-fuel ratio approaches the target air-fuel ratio.

6. An apparatus for controlling the air-fuel ratio of an internal combustion engine according to claim 5, wherein said separate cylinder group air-fuel ratio control means corrects separately for each cylinder group, an operating amount for the air-fuel ratio control value set by the separate cylinder group control value setting means, based on the separate air-fuel ratio control value for each cylinder group converted by said control value conversion means.

7. A method of controlling the air-fuel ratio of an internal combustion engine employing first and second oxygen sensors provided in respective exhaust paths independently provided for each of two cylinder groups, for detecting the oxygen concentration in the exhaust gases of each cylinder group, and a third oxygen sensor in an exhaust path downstream of an exhaust gas purification catalytic converter, which takes the combined exhaust gases of the two cylinder groups, for detecting the oxygen concentration in the combined exhaust gases, said method including the steps of;

setting an air-fuel ratio control value separately for each cylinder group based on the oxygen concentrations for each cylinder group, respectively detected by the first and second oxygen sensors, setting a common air-fuel ratio control value for each cylinder group based on the oxygen concentration detected by the third oxygen sensor, converting the common air-fuel ratio control value for each cylinder group into a separate air-fuel ratio control value for each cylinder group based on said air-fuel ratio control value set separately for each cylinder group, and controlling the air-fuel ratio independently for each cylinder group based on the air-fuel ratio control value set separately for each cylinder group, and the separate air-fuel ratio control value for each cylinder group obtained by conversion of the common air-fuel ratio control value.

8. A method of controlling the air-fuel ratio of an internal combustion engine according to claim 7, wherein said step of converting the common air-fuel ratio control value for each cylinder group into a separate air-fuel ratio control value for each cylinder group involves; convening the air-fuel ratio control value set as a common value for each cylinder group into a separate air-fuel ratio control value for each cylinder group based on a comparison of the air-fuel ratio control value set separately for each cylinder group with the initial value.

9. A method of controlling the air-fuel ratio of an internal combustion engine according to claim 8, wherein said step of converting the common air-fuel ratio control value for each cylinder group into a separate air-fuel ratio control value for each cylinder group involves; multiplying the air-fuel ratio control value set as a common value for each cylinder group, by the ratio of the air-fuel ratio control value set separately for each cylinder group to the initial value, to convert the common value it into a separate air-fuel ratio control value for each cylinder group.

10. A method of controlling the air-fuel ratio of an internal combustion engine according to claim 8, wherein said step of converting the common air-fuel ratio control value for each cylinder group into a separate air-fuel ratio control value for each cylinder group involves; detecting the respective air-fuel ratio deviation characteristics for each cylinder group based on a comparison of the air-fuel ratio control value set separately for each cylinder group with the initial value, and correctingly setting the common air-fuel ratio control value for each cylinder group in a direction to suppress the respective base air-fuel ratio deviations of each cylinder group, thus convening the common air-fuel ratio control value into a separate air-fuel ratio control value for each cylinder group.

11. A method of controlling the air-fuel ratio of an internal combustion engine according to claim 7, wherein said step of setting an air-fuel ratio control value for each cylinder group, and said step of setting a common air-fuel ratio control value for each cylinder group, involves judging the richness or leanness of the actual air-fuel ratio compared to the target air-fuel ratio based on the outputs of the oxygen sensors, and changing the air-fuel ratio control value in a direction so that the actual air-fuel ratio approaches the target air-fuel ratio.

12. A method of controlling the air-fuel ratio of an internal combustion engine according to claim 11, wherein said step of controlling the air-fuel ratio separately for each cylinder group involves; correcting separately for each cylinder group, an operating amount for the air-fuel ratio control value at the time of setting the air-fuel ratio control value separately for each cylinder group, based on the separate air-fuel ratio control value for each cylinder group obtained by conversion of the common air-fuel ratio control value for each cylinder group.

* * * * *